United States Patent [19]

Gach

[11] Patent Number: 4,807,768

[45] Date of Patent: Feb. 28, 1989

[54] CHILD RESISTANT DISPENSING CLOSURE

[75] Inventor: Peter P. Gach, Evansville, Ind.

[73] Assignee: Sunbeam Plastics Corporation, Evansville, Ind.

[21] Appl. No.: 184,754

[22] Filed: Apr. 22, 1988

[51] Int. Cl.[4] ..... B65D 55/02

[52] U.S. Cl. ..... 215/216; 215/211; 215/237; 222/153

[58] Field of Search ..... 215/211, 216, 235, 237, 215/224, 301; 220/281; 222/153, 498, 546, 517

[56] References Cited

U.S. PATENT DOCUMENTS

| | | | |
|---|---|---|---|
| 3,604,585 | 9/1971 | Towns . | |
| 4,047,495 | 9/1977 | O'Brian | 215/224 |
| 4,209,100 | 6/1980 | Uhlig | 215/216 |
| 4,220,262 | 9/1980 | Uhlig | 222/153 |
| 4,257,537 | 3/1981 | Uhlig | 222/153 |
| 4,358,032 | 11/1982 | Libit | 222/498 |
| 4,444,326 | 4/1984 | Musel | 215/209 |
| 4,467,931 | 8/1984 | Gach | 215/237 |
| 4,513,888 | 4/1985 | Curry | 222/153 |
| 4,533,058 | 8/1985 | Uhlig | 215/216 |
| 4,629,081 | 12/1986 | McLaren | 215/206 |
| 4,718,567 | 1/1988 | La Vange | 215/216 |
| 4,723,669 | 2/1988 | Barriac | 215/216 |

FOREIGN PATENT DOCUMENTS 1527812 10/1978 United Kingdom .

*Primary Examiner*—George T. Hall

*Attorney, Agent, or Firm*—Irvin L. Groh; Alfred L. Patmore, Jr.

[57] ABSTRACT

A dispensing closure molded with a polypropolyene or other plastic material having a base cup with a dispensing orifice in its top and a lid hinged to the cap for closing the orifice. The lid is recessed in the base cap and has projecting tabs which are pushed to release detent locks so that the lid may be swung to an open, dispensing position. Arcuate slots through the lid, in line with the tabs, allow sufficient deflection of the lid to unlock the the detents.

21 Claims, 1 Drawing Sheet

CHILD RESISTANT DISPENSING CLOSURE

This invention relates to a dispensing closure, and more particularly to a child resistant dispensing closure.

There are a wide variety of child resistant closures available. Whether or not the closure is of a dispensing type, the most successful child resistant closures require two separate and dissimilar movements or actions to open or remove the closure. These movements may be simultaneous or sequential.

In the case of a dispensing closure, a base cap is normally provided with a dispensing orifice located in its top, and a lid member is hinged to the base cap for swinging between the closed position covering the orifice and an open position for dispensing the product therethrough.

By providing alignment with the base cap or recessing the lid in the base cap top when the lid is in its closed position covering the dispensing orifice, a child resistant feature is effected. The lid cannot be merely grasped to exert an opening force without a first movement or action to unlock the lid or expose an edge of the lid so lid to an open dispensing position. There are a number of these aligned or recessed lid, child resistant, dispensing closures available.

In some of the available closures, the initial force is applied by finger pressure exerted against the top of the closure lid to expose an edge of the lid for application of a second pivotal opening force. The disadvantage of this type of closure is that the downward force may be inadvertently applied by the child by banging or dropping the closure on a hard surface. Closures which provide an initial finger purchase by squeezing a portion of the base cap have largely overcome this "accidental opening" disadvantage of a top force actuated closure. Application of a lateral squeezing force to the closure skirt wall, pushing the wall inwardly to release a lid latch or to provide a finger purchase on the lid has been implemented in a number of closures by providing a recess in the base cap wall. Since it is difficult to provide sufficient side wall displacement with a skirt wall recess, particularly where the base cap has a plug seal to the container neck, additional expediencies have been incorporated to increase displacement. Scoring or slotting of the skirt wall within the circumferential extent of the slot has been used to enhance movement with a sacrifice of side wall integrity.

The instant invention overcomes the disadvantages of the prior art structures utilizing a base cap and hinged lid in which the initial opening force is applied to the lid rather than to the base cap. The base cap has a top with a dispensing orifice therethrough and an annular skirt which has a portion depending downwardly from the periphery of the top with means for attachment to the container neck, and a portion of the annular skirt extends upwardly to form a recess. A circular lid fits in the recess in contact with the upwardly extending portion of the annular cap skirt and is either flush with the top of the skirt or recessed slightly below. The hinge connects the lid to the cap allowing the lid to be swung between a closed position in the recess covering the dispensing orifice and an open dispensing position.

The lid has at least one tab extending radially outward through a slot in the upwardly extending portion of the annular cap skirt. An arcuate slot extends through the lid in line and adjacent to the tab terminating in ends which are circumferentially beyond the tab. A detent adjacent to the tab locks the lid to the cap skirt. The arcuate slot allows movement of the lid when the tab is pushed to release the detent so that the lid can be swung from its closed position to an open dispensing position.

A plug is provided on the lid for engaging and sealing the dispensing orifice in its closed position. Preferrably, a nozzle surrounds the dispensing orifice extending upwardly from the cap top to aid in directing the product being dispensed from the container to which the closure is attached. The nozzle terminates in a plannar lip against which the lid seats in its closed position.

The detent can take the form of a projection extending radially outward from the edge of the lid adjacent to the tab or a projection extending radially inward from the upwardly extending portion of the cap skirt which engages a recess in the other part. Preferrably the detent takes the form of two spherical projections extending radially outward from the lid on either side of the tab within the circumferential extend of the arcuate slot. Corresponding spherical depressions are provided in the upwardly extending portions of the cap skirt.

In a preferred form the lid has a pair of diametrically opposed tabs in a plane normal to a plane through the orifice plug and hinge. The tabs extend radially outward through slots in the upwardly extending portion of the annular skirt. A pair of diametrically opposed arcuate slots extend through the lid adjacent to and in line with the tabs with their ends terminating circumferentially beyond the tabs. Simultaneous finger pressure on both of the tabs releases the detent lock allowing the lid to be swung from its closed position to an open dispensing position.

In another form of the invention the lid has a single tab extending radially outward through a slot in the upwardly extending portion of the annular cap skirt in line with the dispensing orifice and hinge. An arcuate slot extends through the lid adjacent to and in line with the tab extending circumferentially beyond the tab. Inward pressure on the tab allows deformation of the lid into the slot area unlocking the detent to permit swinging the lid from a closed position to an open dispensing position.

The base cap preferrably is provided with means for permanently attaching it to the container neck so that dispensing must take place through the dispensing orifice. Preferrably the base cap has an inner skirt concentric with the outer skirt. The inner skirt is internally threaded for engagement with complementary threads on the container neck. The outer skirt is provided with means for permanent attachment to the container neck. It can take the form of inwardly directed ratchet teeth which engage ratchet teeth on the container neck which allows the cap to be threaded on but prevents it from being unthreaded.

The base cap is sealed to the container neck. This can take the form of an annular fin seal which presses against the end of the container neck.

The preferred embodiments of the invention are illustrated in the drawing in which.

Figure 1:
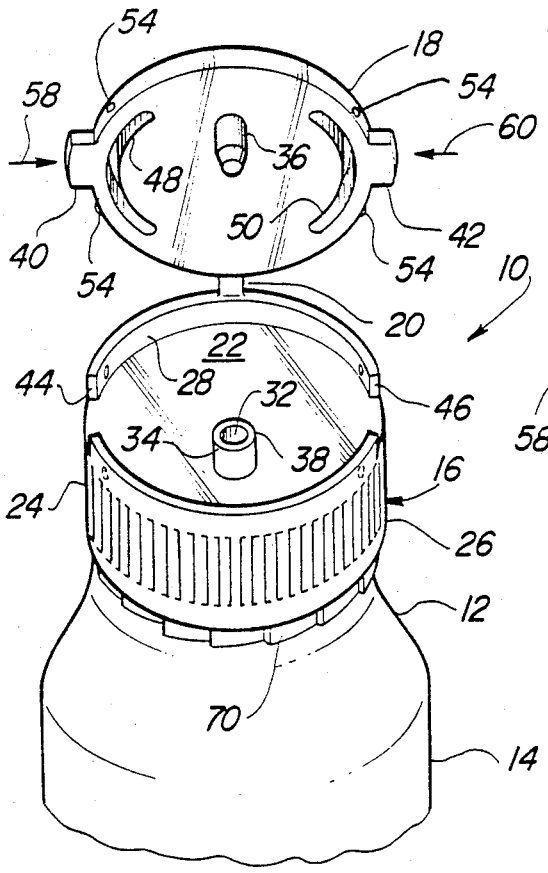
FIG. 1 is a perspective view showing the closure of this invention attached permanently to a container neck with the lid in an open dispensing position and additionally showing the direction in which the lid tabs must be depressed to release the detent locking mechanism.

Referring to the drawing, dispensing closure 10 is shown attached to neck 12 of container 14. Closure 10 includes a base cap 16, a lid 18, and a connecting hinge 20. The base cap 16, lid 18, and hinge 20 can be integrally molded with the hinge 20 being of the so-called living or live type, as shown, or the base cap and lid can be separately molded utilizing a spaced post and slot hinge which is assembled to join the lid to the cap.

Figure 4:
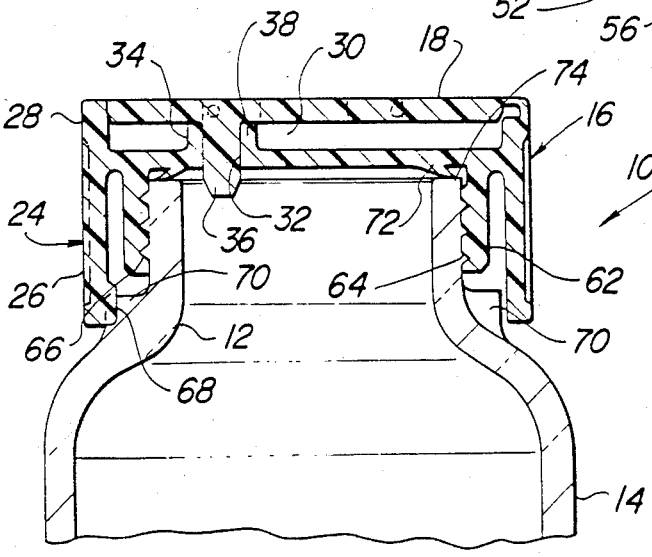
FIG. 4 is a sectional elevational view taken along line 4—4 of FIG. 2 showing the lid plug engaged in the dispensing orifice and the details of the closure sealing and attachment means.

Base cap 16 has a plannar top 22 and an annular side wall or skirt 24 having a portion 26 depending downwardly from the periphery of top 22 and a portion 28 extending upwardly to form recess 30, see FIG. 4, in which the lid 18 fits. A dispensing orifice 32 extends through the cap top 22, and, in a preferred form, a nozzle 34 surrounds the orifice and extends upwardly form the cap 20 to direct the contents of the container from which it is being dispensed.

As best seen in FIG. 4 base cap 16 has an inner skirt 62 concentric with annular cap skirt 16. Inner skirt 62 is provided with threads 64 which engage container neck threads 66 for attaching closure 10 to container neck 12. In order to make the attachment more permanent the lower portion 26 of cap skirt 24 is provided with ratchet teeth 68 which engage ratchet teeth 70 on bottle neck 12. The ratchet teeth are ramped in a customary manner so that closure teeth 68 pass over container neck teeth 70 as the cap 16 is being threaded onto the container neck but prevent unthreading of the closure.

The base cap 16 is sealed to container neck 12 by the use of an annular fin seal 72 which presses against end 74 of container neck 12.

The ratchet teeth can also be formed as axially extending teeth on the container neck to coact with ratchet teeth or a yielding gasket on the underside of the cap top, as more fully set forth in my copending patent application Ser. No. 26,206, filed Mar. 16, 1987.

Other forms of permanent or semi permanent attachment of the closure to the container neck can be used. For example, the inner skirt and threads can be eliminated and an inwardly directed bead can be formed on the bottom of the cap skirt which coacts with a flange on the container neck to provide snap on retention of the closure on the container neck, as more fully set forth in my copending patent application Ser. No. 23,832 filed Mar. 9, 1987.

Alternatively a gasket can be used in this position, and in some instances the gasket can take the form of a metallic foil which has a heat sealing compound on both sides which can be inductively heated to fuse the cap to the container neck providing both the sealing of the closure to the neck and its permanent attachment thereto.

Lid 1 is cylindrical, fitting closely to the upwardly extending portion 28 of cap skirt 24 in recess 30. A plug 36 extends downwardly from lid 18 to sealingly engage dispensing orifice 32 and nozzle 34. When the lid is in its closed position, it coacts or seats against the plannar lip 38 of nozzle 34 providing a flush or slightly recessed mounting of the lid 18 with respect to the upwardly extending cap skirt portion 28, as best seen in FIG. 4.

Figure 2:
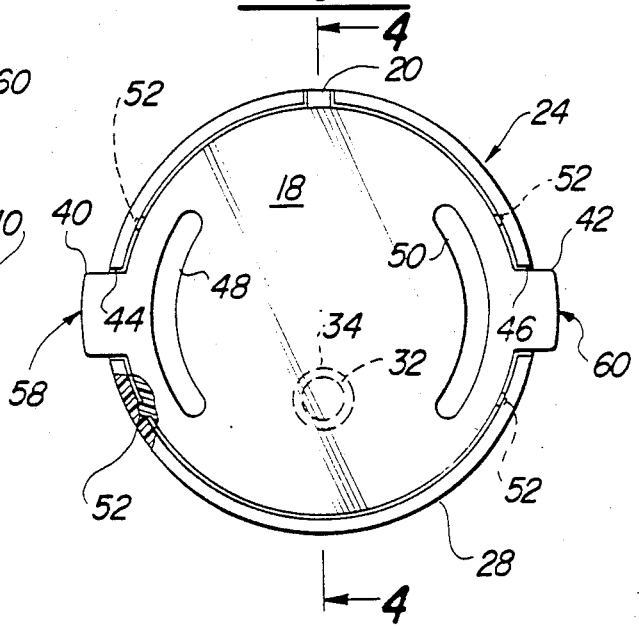
FIG. 2 is a plan view showing the lid in its closed position with a portion in section to show the details of one of the locking detents.

In the embodiments of the invention shown in Figs. 1–4, the lid 18 is provide with a pair of radially extending, diametrically opposed tabs 40 and 42 which extend outwardly through slots 44 and 46 in upper skirt portion 28 when the lid is in a closed position as shown in FIG. 2. A pair or arcuate slots 48 and 50 extend through the lid 18 in line with tabs 40 and 42. Slots 48 and 50 provide sufficient space for the lid to be distorted as the tabs 40 and 42 are pushed inwardly in the direction of arrows 58 and 60; see slot as shown at 48' in FIG. 3. A plane containing tabs 40, 42 and slots 48, 50 are perpendicular or normal to a plane through hinge 20 and plug 36.

Figure 3:
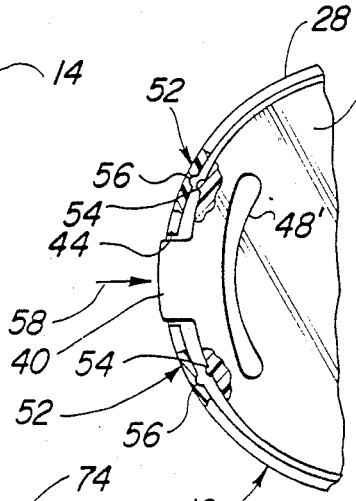
FIG. 3 is a fragmentary plan view similar to FIG. 2 showing the lid tab depressed with portions in section to show both detent locks in their released position.

Detent locking means 52 in the form of a spherical projections 54 extend outwardly from the edge of lid 18 into indentations 56 in the upper cap skirt portion 28. A detent 52 is provided adjacent to and on each side of both tabs 40 and 42 to hold the lid in a locked position on the base cap as shown in FIG. 2. Detents 52 are within the circumferential extent of arcuate slots 48 and 50 so that when the user applies finger pressure on the opposing tabs as shown by arrows 58 and 60, the detents 52 are released as shown in FIG. 3 and the lid 18 can be raised to a dispensing position as shown in FIG. 1.

Figure 5:
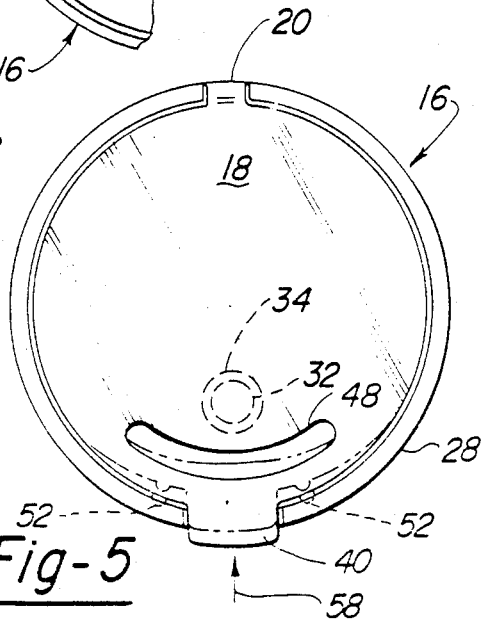
FIG. 5 is a plan view similar to FIG. 4 showing another embodiment of the invention which utilizes a single tab for releasing a detent locking mechanism.

FIG. 5 shows an alternate embodiment in which a single tab 40 is used in conjunction with a single arcuate slot 48. In this case the tab and arcuate slot are in line with the dispensing orifice 32 and hinge 20. The depressed position of tab 40, the deformed position of arcuate slot 48 and the unlocked position of detents 52 are shown in phantom in FIG. 5.

The embodiments of the invention in which an exclusive property or privilege is claimed are defined as follows:

1. A dispensing closure for a container neck comprising:

a base cap having a top with a dispensing orifice therethrough, an annular skirt having a portion depending from the periphery of said top and a portion extending upwardly to form a recess, and means for attachment to said container neck;

a circular lid fitting in said recess contiguous with the upwardly extending portion of said annular cap skirt when said lid is in a closed position covering said orifice;

a hinge connecting said lid to said cap allowing said lid to be swung between said closed position covering said orifice and an open dispensing position;

said lid having a tab extending radially outward through a slot in the upwardly extending portion of said annular cap skirt;

an arcuate slot extending through said lid adjacent to and terminating in ends circumferentially beyond said tab; and detent means adjacent said tab, locking said lid to the upwardly extending portion of said cap skirt;

whereby said tab can be pushed inwardly to release said detent means allowing the lid to be swung from said closed position to said open dispensing position.

2. The dispensing closure according to claim 1 wherein said lid is formed with a depending plug engageable with said dispensing orifice to seal said dispensing orifice when said lid is in said closed position.

3. The dispensing closure according to claim 1 further including a nozzle surrounding said orifice extending upwardly from said cap top to direct the dispensing of a product from a container to which the dispensing closure is attached.

4. The dispensing closure according to claim 3 wherein said nozzle terminates in a planar lip and said lid seats against said lip when in said closed position.

5. The dispensing closure according to claim 4 further including a plug depending from said lid engageable with said dispensing orifice to seal said dispensing orifice when said lid is in said closed position seated against said nozzle lip.

6. The dispensing closure according to claim 1 further including means for sealing said closure to said container neck.

7. The dispensing closure according to claim 6 wherein said sealing means includes an annular fin depending from said cap top which engages said container neck.

8. The dispensing closure according to claim 1 wherein said attachment means includes means located at the bottom of said depending cap skirt portion which coacts with stop means on said container neck.

9. The dispensing closure according to claim 1 wherein said base cap further includes an inner skirt depending from said cap top concentric with said annular skirt, and said means for attachment includes internal threads on said inner skirt for engagement of complementary threads on said container neck.

10. The dispensing closure according to claim 9 where in said means for attachment includes in addition to said internal threads, further means for permanently attaching said base cap to said container neck.

11. The dispensing closure according to claim 10 wherein said further means for permanently attaching said base cap to said container neck includes ratchet teeth on the downwardly depending portion of said cap skirt which coacts with ratchet teeth on said container neck to prevent unthreading of said cap.

12. The dispensing closure according to claim 1 wherein said detent means includes a detent on both sides of said tab, between said tab and the ends of said arcuate slot.

13. The dispensing closure according to claim 1 further including a second diametrically opposed tab, a second diametrically opposed arcuate slot, and second detent means adjacent said second tab; whereby said tabs are pushed in at the same time to release their associated detent means.

14. The dispensing closure according to claim 13 wherein said tabs and arcuate slots are centered in a plane normal to a plane extending through said hinge and dispensing orifice.

15. The dispensing closure according to claim 1 wherein said tab and arcuate slot are centered in a plane extending through the center of said dispensing orifice and said hinge.

16. The dispensing closure for a container neck comprising:

a base cap having a top with a dispensing orifice therethrough, an annular skirt having a portion depending downwardly from the periphery of said top and a portion extending upwardly to form a recess, and means for attachment to said container neck;

a circular lid fitting in said recess contiguous with the upwardly extending portion of said annular cap skirt when said lid is in the closed position covering said orifice;

a hinge connecting said lid to said cap allowing said lid to be swung between said closed position covering said orifice and an open dispensing position;

a plug diametrically in line with said hinge depending from said lid for engaging and sealing said dispensing orifice when said lid is in said closed position;

said lid having a pair of diametrically opposed tabs in a plane normal to a plane through said plug and hinge extending radially outward through slots in the upwardly extending portion of said annular cap skirt;

a pair of diametrically opposed arcuate slots extending through said lid adjacent to and in line with said tabs and terminating in ends circumferentially beyond said tabs;

and detent means adjacent each tab, locking said lid to the upwardly extending portion of said cap skirt;

whereby said tabs can be simultaneously pushed inwardly to release said detent means allowing the lid to be swung from said closed position to said open dispensing position.

17. The dispensing closure according to claim 16 wherein said detent means includes projections extending radially from one of said lid and said cap skirt on both sides and adjacent each of said tabs toward complementary receiving recesses in the other of said lid and cap skirt.

18. The dispensing closure according to claim 17 wherein said detent means includes spherical projections extending radially outward from said lid on both sides and adjacent each of said tabs toward complementary spherical recesses in the upwardly extending portion of said cap skirt.

19. The dispensing closure according to claim 16 wherein said means for attachment to said container neck includes means associated with said cap skirt which coacts with stop means on said container neck to permanently attach said base cap to said container neck.

20. A dispensing closure for a container neck comprising:

a base cap having a top with a dispensing orifice therethrough, an annular skirt having a portion depending from the periphery of said top and a portion extending upwardly to form a recess, and means for attachment to said container neck;

a circular lid fitting in said recess contiguous with the upwardly extending portion of said annular cap skirt when said lid is in the closed position covering said orifice;

a plug depending from said lid for engaging and sealing said dispensing orifice;

a hinge diametrically in line with said plug and dispensing orifice connecting said lid to said cap allowing said lid to be swung between said closed position covering said orifice with said plug sealingly engaging said dispensing orifice and an open dispensing position;

said lid having a tab in line with said plug extending radially outward through a slot in the upwardly extending portion of said annular skirt;

an arcuate slot in line with said tab extending through said lid adjacent to and terminating in ends circumferentially beyond said tab;

and detent means adjacent said tab locking said lid to the upwardly extending portion of said cap skirt;

whereby said tab can be pushed inwardly to release said detent means allowing the lid to be swung from said closed position to said open dispensing position.

21. The dispensing closure of claim 20 wherein said detent means includes spherical projections extending radially outward from said lid on both sides and adjacent said tab toward complementary spherical recesses in the upwardly extending portion of said cap skirt.

* * * * *

UNITED STATES PATENT AND TRADEMARK OFFICE

CERTIFICATE OF CORRECTION

PATENT NO. : 4,807,768

DATED : Feb. 28, 1989

INVENTOR(S) : Peter P. Gach

It is certified that error appears in the above-identified patent and that said Letters Patent is hereby corrected as shown below:

Title page:

In the Abstract: line 2, delete "cup" and insert --cap--

Col. 1, line 24, before "lid" insert --that a second movement or action can be applied to swing the--

Col. 3, line 63, delete "1" and insert --18--

Signed and Sealed this

Twentieth Day of February, 1990

*Attest:*

JEFFREY M. SAMUELS

*Attesting Officer*

*Acting Commissioner of Patents and Trademarks*